US009057585B1

(12) United States Patent
Veldman et al.

(10) Patent No.: US 9,057,585 B1
(45) Date of Patent: Jun. 16, 2015

(54) ILLUMINATION ASSOCIATED WITH A WEAPON

(71) Applicant: Trifecta Tactical LLC, Kennewick, WA (US)

(72) Inventors: Timothy G. Veldman, Kennewick, WA (US); Dale Crane, Fort Worth, TX (US)

(73) Assignee: Trifecta Tactical LLC, Kennewick, WA (US)

( * ) Notice: Subject to any disclaimer, the term of this patent is extended or adjusted under 35 U.S.C. 154(b) by 0 days.

(21) Appl. No.: 14/278,291

(22) Filed: May 15, 2014

(51) Int. Cl.
*F41G 1/00* (2006.01)
*F41G 1/35* (2006.01)

(52) U.S. Cl.
CPC ..... *F41G 1/35* (2013.01)

(58) Field of Classification Search
CPC ..... F41G 1/35; F41G 1/34; F21V 33/00; F21V 23/0414
USPC ..... 42/146; 362/110, 113, 114
See application file for complete search history.

(56) References Cited

U.S. PATENT DOCUMENTS

| | | | | |
|---|---|---|---|---|
| 5,208,417 | A * | 5/1993 | Langer et al. | 89/41.06 |
| 5,669,174 | A * | 9/1997 | Teetzel | 42/115 |
| 6,785,996 | B2 | 9/2004 | Danner et al. | |
| 7,346,400 | B2 | 3/2008 | Cross et al. | |
| 7,708,426 | B2 | 5/2010 | Dalton et al. | |
| 8,721,103 | B2 * | 5/2014 | Robinson | 362/105 |
| 8,894,231 | B2 * | 11/2014 | Kwok | 362/105 |
| 2007/0028501 | A1 * | 2/2007 | Fressola et al. | 42/146 |
| 2010/0219775 | A1 * | 9/2010 | Maglica et al. | 315/362 |
| 2011/0012534 | A1 * | 1/2011 | West et al. | 315/307 |
| 2011/0012535 | A1 * | 1/2011 | West et al. | 315/307 |

OTHER PUBLICATIONS

Trifecta Tactical, "The MERK Light," Web Page. First crawled by the Wayback Machine on May 27, 2012, visited on Apr. 16, 2014. <http://web.archive.org/web/20120527192840/http://www.trifectatactical.com/the-merk-light.html>, 1 page.

* cited by examiner

*Primary Examiner* — Samir Abdosh
(74) *Attorney, Agent, or Firm* — Klarquist Sparkman, LLP

(57) ABSTRACT

The disclosed embodiments relate to illumination associated with a weapon. In one embodiment, a lighting device for mounting on a weapon comprises a light source, an inertial sensor, and a controller. The light source can be used to illuminate a portion of a target. The inertial sensor can be used for sensing the forces acting on the lighting device. The controller can be configured to activate the light source when the lighting device is in a firing position for more than a first predetermined time period, and deactivate the light source when the lighting device is in a non-firing position for more than a second predetermined time period.

21 Claims, 9 Drawing Sheets

ILLUMINATION ASSOCIATED WITH A WEAPON

FIELD

The disclosed embodiments relate to selectively illuminating at least a portion of a target area of a weapon.

BACKGROUND

During military, police, and/or home-defense situations, a suspect may be encountered in low-light or dark conditions. On the one hand, it may be prudent to observe or approach the potentially dangerous suspect in a stealthy manner so that the suspect does not attempt to flee and/or injure the observer. For example, it can be prudent to approach the potentially dangerous suspect while maintaining the low-light conditions. On the other hand, a weapon can be better aimed and the suspect can be better ascertained when the suspect is illuminated with a light. For example, a light can be used to identify the suspect as a friend or a foe prior to using the weapon.

In one solution, a hand-held flashlight can be used to illuminate the suspect. For example, a police officer, soldier, or home-owner (e.g., the operator of the weapon) can approach the suspect with the flashlight off, and switch on the flashlight when the suspect is within range of a weapon. However, it can be difficult to hold and accurately aim the weapon and the flashlight at the same time. For example, the beam of light from the flashlight may be misaligned or "counter-witnessed" from the sight of the weapon. When the beam of light and weapon sight are counter-witnessed, the operator of the weapon may inadvertently think that he or she is aiming where the light-beam is directed, rather than where the sight and firing line of the weapon are pointing. Thus, the operator of the weapon may miss the target and be subjected to return hostile fire from the suspect.

In another solution, a light can be mounted to the weapon and the light can be activated by applying pressure to a pressure-activated grip of the weapon. In this solution, the light remains off when the grip of the weapon is held lightly, and the light is switched on when the grip of the weapon is held tightly. Thus, a skilled operator of the weapon can approach a suspect with the light off by lightly gripping the weapon during the approach, and switch on the light by increasing grip pressure at the appropriate time. However, unskilled operators and even skilled operators may find it difficult to control his or her fine motor skills in intense or stressful situations. For example, in a stressful situation the operator of the weapon may prematurely squeeze the grip of the firearm, creating a risk that the suspect will detect the operator and respond.

SUMMARY

Accordingly, various embodiments are disclosed herein related to illumination associated with a weapon. In one embodiment, a lighting device for mounting on a weapon comprises a light source, an inertial sensor, and a controller. The light source can be used to illuminate a portion of a target. The inertial sensor can be used for sensing forces acting on the lighting device. For example, the orientation of the lighting device can be determined based on the forces acting on the lighting device. The controller can be in communication with the light source and the inertial sensor. The controller can be configured to activate the light source when the lighting device is in a firing position for more than a first predetermined time period, and deactivate the light source when the lighting device is in a non-firing position for more than a second predetermined time period. For example, the first predetermined time period can be between one millisecond and one second, and the second predetermined time period can be between 0.5 second and five seconds. The firing position and the non-firing position can be mutually exclusive, and the firing position can include a roll of the lighting device within plus or minus sixty degrees of upright and a pitch of the lighting device within plus or minus sixty degrees of horizontal. The controller can be further configured to calibrate the lighting device when a user puts the lighting device in a calibration mode. Calibration can include basing a reference orientation on one or more samples from an output of the inertial sensor during the calibration mode. The lighting device can comprise a switch in communication with the controller, and the controller can be configured to enter the calibration mode when the switch is operated by the user in a predetermined manner. For example, the switch can be a push-button switch and the calibration mode can be entered when the push-button switch is pressed by the user for more than a predetermined amount of time. The lighting device can comprise a metallic heat-sink defining a cavity for receiving a battery in the cavity. The heat-sink can be in thermal contact with the light source. The heat-sink can include eight to fifteen fins projecting radially from a central axis of the heat-sink. A majority of the fins can include a semicircular cut-out near a perimeter of a respective fin. The semicircular cut-outs of adjacent fins can form the cavity for receiving the battery. The lighting device can comprise a housing including a polished parabolic cavity. The light source can be positioned near a focus of the parabolic cavity along a longitudinal axis of the parabolic cavity. The lighting device can comprise optics configured to present a brighter central beam surrounded by a less bright halo concentrically arranged around the center of the central beam when the light source is activated. For example, the optics can comprise a lens that can include a double convex central lens portion surrounded by an annular straight sided lens portion. The lens can be positioned near an end of the parabolic cavity farthest from the vertex of the parabolic cavity. The light source can be configured to illuminate the portion of the target with a pin-point spot when the light source is activated.

In an alternate embodiment, a system comprises a weapon, a light source, an inertial sensor, and a controller. The light source is connected to the weapon and oriented to illuminate an area within a range of the weapon when the light source is activated. The inertial sensor is used for sensing the forces acting on the weapon. The orientation of the weapon can be determined based on the forces acting on the weapon. The controller can be configured to store a reference orientation of the weapon based on one or more samples of an output of the inertial sensor when the system is in a calibration mode selected by a user of the system. The controller can be configured to determine a position of the weapon based on a difference between the reference orientation and a present orientation of the weapon. The controller can be configured to activate the light source when the weapon is in a firing position for more than a first predetermined time period. The controller can be configured to deactivate the light source when the weapon is in a non-firing position for more than a second predetermined time period. For example, the firing position and the non-firing position can be mutually exclusive, and the firing position can include a roll of the weapon within plus or minus sixty degrees of upright and a pitch of the weapon within plus or minus sixty degrees of horizontal. The pitch and the roll can be measured relative to the reference orientation. The system can comprise a push-button switch in communication with the controller, and the controller can be configured to put the system in a calibration mode when the push-button switch is pressed for more than a third predetermined amount of time. The system can comprise optics configured to present a brighter central beam surrounded by a less bright halo concentrically arranged around the center of the central beam when the light source is activated.

In an alternate embodiment, a computer-readable storage includes instructions thereon for executing a method for controlling a light source for mounting on a firearm. The method can comprise storing a reference orientation of the firearm during a user-initiated calibration of the light source. The method can comprise sensing a present orientation of the firearm. The method can comprise determining a position of the firearm based on a difference between the present orientation and the reference orientation. The position can consist of a firing position and a non-firing position. The method can comprise activating the light source when the firearm is in the firing position for more than a first predetermined time period. The method can comprise deactivating the light source when the firearm is in the non-firing position for more than a second predetermined time period. The first predetermined time period can be between one millisecond and one second, and the second predetermined time period can be between 0.5 second and five seconds. The firing position and the non-firing position can be mutually exclusive, and the firing position can include a roll of the firearm within plus or minus sixty degrees of upright and a pitch of the firearm within plus or minus sixty degrees of horizontal. The pitch and the roll can be measured relative to the reference orientation.

In an alternate embodiment, a lighting device for mounting to a hand-held weapon comprises a light source, an inertial sensor, and a controller. The light source can illuminate at least a portion of a target. The inertial sensor can sense forces acting on the lighting device and the weapon. The controller can be in communication with the light source and the inertial sensor. The controller can include a system to sample outputs from the inertial sensor at preset time intervals to establish a physical orientation for the lighting device and the weapon. The system can compare the physical orientation to a reference orientation. The system can responsively activate or deactivate the light source when the relationship between the physical and reference orientations fall within a preset value range for a predetermined time period.

The foregoing and other objects, features, and advantages of the invention will become more apparent from the following detailed description, which proceeds with reference to the accompanying figures.

DETAILED DESCRIPTION

Figure 1:
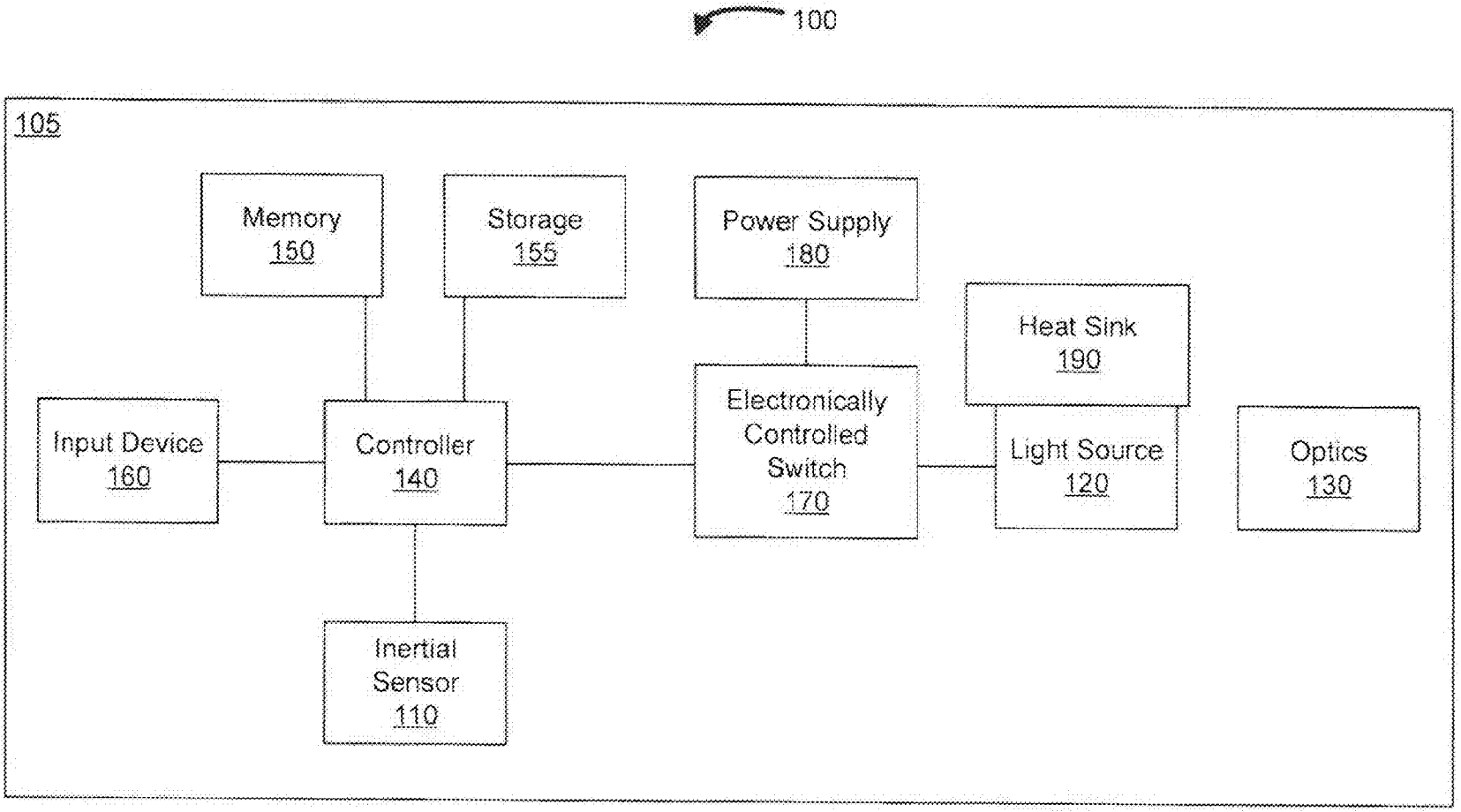
FIG. 1 is a schematic flow-chart illustrating the operation of an embodiment of a lighting device for a firearm.

The present disclosure relates to selectively illuminating a target area of a weapon. In one embodiment, a lighting device for mounting on a weapon is disclosed. The lighting device can include a light source to selectively illuminate a portion of a target, an inertial sensor for sensing the forces acting on the lighting device, and a controller in communication with the light source and the inertial sensor. As one example, the lighting device can be mounted on a weapon, and the operator of the weapon can use the lighting device to tactically illuminate a target area.

Tactical illumination can include coincidental control of the light from the lighting device. In other words, the operator can switch the light source on and off as a coincidence of the normal operation of the weapon. For example, a firing position of a readied weapon can be different from a non-firing position of the weapon, such as when the weapon is laid down, holstered, racked, held in a low-ready position, or held in a high-ready position. The controller can be configured to identify and distinguish between a firing position and a non-firing position based on an orientation of the weapon and the motion of the operator. For example, the controller can be configured to activate the light source when the lighting device is in a firing position for more than a first predetermined time period, and to deactivate the light source when the lighting device is in a non-firing position for more than a second predetermined time period.

The first predetermined time period can be longer than the time that it takes to transition from one non-firing position to another non-firing position. For example, a professional gun-operator, such as a police officer or a swat-team member, may approach a suspect through an orchestrated set of moves. The operator may begin the approach with the weapon held in a low-ready position (e.g., pointed down) and then transition the weapon to a high-ready position (e.g., pointed up). The operator may run with the weapon such that the weapon transitions through a series of orientations with the weapon moving from pointing up to pointing down in unison with the arm movements of the running operator. As the weapon transitions from one non-firing position to another non-firing position, the weapon may briefly pass through a generally horizontal position. By keeping the light off for longer than the transitional period, the operator can potentially approach a suspect without telegraphing his or her position to the suspect.

The light can be switched on when the weapon is in the firing position for more than the first predetermined time period, such as when the operator is aiming the weapon at a target area. For example, the weapon can be in the firing position when the weapon is held in a generally horizontal position for longer than the transitional period. When the weapon is in the firing position and the light is on, the operator can surveil the target area of the weapon and/or attempt to identify the suspect, prior to operating the weapon. If the target area is clear, the operator can return to a stealthy mode by returning the weapon to a non-firing position for more than the second predetermined time period.

The second predetermined time period can be longer than the time it takes for an operator to recover from a recoil of the weapon, but short enough for the operator to continue a search without undue delay. For example, a fired weapon can recoil, causing the weapon to point off-target, and the operator will likely want to re-aim the weapon at the target after firing the weapon. By keeping the light on during the time period between firing the weapon and re-aiming, the operator can use the light to reacquire the target. As another example, during a search, the operator may aim the weapon and use the light to surveil an area, and then the operator may move the weapon to a non-firing position to turn the light off and continue the search. If the operator desires to continue the search with the light off, the delay until the light switches off will delay the search. Thus, the second predetermined time period can be set slightly longer than the time to recover from a recoil of the weapon so that the operator can use the light to reacquire a target after firing the weapon while not being unduly delayed during a search when the weapon is not fired.

Turning to the figures, FIG. 1 is a schematic flow-chart illustrating the operation of an embodiment of a lighting device 100 for a firearm. The lighting device 100 can include a housing 105 for fully or partially enclosing components of the lighting device 100. The lighting device 100 can include an inertial sensor 110, a light source 120, optics 130, and a controller 140. The light source 120 can include a light emitting diode (LED), an incandescent lamp, a laser, or any electrical component suitable for generating light within a few hundred milliseconds after being activated. The firearm may generate sudden accelerations and/or vibrations when fired, and so solid-state components such as LEDs and lasers may be preferable compared to light sources with a filament, such as an incandescent lamp. The light source 120 can generate white light, red light, or any color or combination of colors within the frequency range of human visual perception. In one embodiment, the light source 120 is a LED producing about 180 lumens of white light. The light source 120 can generate heat when it is activated, and so the lighting device 100 can include a heat sink 190 in thermal contact with the light source 120 for dissipating heat from the lighting device 100.

The optics 130 can be used for directing light from the light source 120 toward a target area. The target area can be a wide area or a small area. The optics 130 can include a curved mirror, a non-curved mirror, a lens, a transparent cover, or any other optical component suitable for reflecting, transmitting, directing, focusing, or filtering light. In one embodiment, the light source 120 is a LED and the optics 130 are configured to illuminate a central portion of the target area with brighter light and an outer portion of the target area with dimmer light. In an alternative embodiment, the light source 120 is a laser and the optics 130 are configured to illuminate a portion of the target with a pin-point spot when the light source 120 is activated.

The inertial sensor 110 can include one or more accelerometers for measuring acceleration relative to at least two axes. Gravity exerts a constant 1 G acceleration toward the center of the earth and so the orientation of a stationary inertial sensor 110 (and the lighting device 100) can be determined by calculating the direction of the 1 G vector. In one embodiment, the inertial sensor 110 includes a three-axis linear accelerometer, such as the LIS344ALH manufactured by STMicroelectronics. The inertial sensor 110 can include an analog or digital output signal that corresponds to the acceleration relative to one axis. Thus, a three-axis linear accelerometer can include three output signals, where each output signal corresponds to the acceleration relative to a different orthogonal axis. In an alternate embodiment, the inertial sensor 110 can be an orientation sensor for determining the orientation of the sensor, and each output signal can correspond to the orientation relative to a different orthogonal axis.

The controller 140 can communicate with the inertial sensor 110 and other electrical and electronic components of the lighting device 100 directly or indirectly via analog or digital signals. For example, an analog output of the inertial sensor 110 can be sampled and converted to a digital signal by an analog to digital converter (ADC) and communicated to the controller 140 in a digital format. As another example, the controller 140 can receive the analog signal directly from the inertial sensor 110, and the controller 140 can sample and convert the analog signal to a digital signal using an integrated ADC of the controller 140.

The controller 140 can be configured or programmed to enable coincidental control of the light from the lighting device 100 when it is mounted on a weapon. The controller 140 can be configured to identify and distinguish between a firing position and a non-firing position based on an orientation of the weapon and the motion of the operator. For example, the controller 140 can sample the outputs from the inertial sensor 110 and calculate the orientation of the weapon based on the samples. The controller 140 can calculate a position based on the orientation of the weapon. The controller 140 can detect events, such as the weapon transitioning from one position to a different position, or the expiration of a predetermined amount of time. The controller 140 can monitor the passage of time and can determine the amount of time between various events. The controller 140 can activate the light source 120 when the lighting device 100 is in a firing position for more than a first predetermined time period, and deactivate the light source 120 when the lighting device 100 is in a non-firing position for more than a second predetermined time period.

The controller 140 can execute computer-executable instructions stored on memory 150 and/or storage 155. In one embodiment, the controller 140 is a PIC18LF13K22 programmable microcontroller manufactured by Microchip Technology, Inc. The tangible memory 150 can be used for temporary or permanent storage of data (such as samples from the inertial sensor 110) and programs (e.g., software) executable by the controller 140. The memory 150 can include volatile memory, non-volatile memory, or a combination of the two. Volatile memory can include registers, cache, and random access memory (RAM), for example. Non-volatile memory can include read only memory (ROM), electrically erasable and programmable ROM (EEPROM), Ferroelectric RAM, and flash memory, for example. The storage 155 can provide long-term storage of data and instructions and can include removable or non-removable non-volatile memory in any medium which can be used to store information in a non-transitory way and which can be accessed by the controller 140.

It should be well understood that multiple electrical and electronic components can be integrated together onto an integrated circuit (IC), such as a field programmable gate array (FPGA), an application specific integrated circuit (ASIC), an application specific standard product (ASSP), a system-on-a-chip (SOC), or a complex programmable logic device (CPLD). For example, the PIC18LF13K22 programmable microcontroller includes a controller, an ADC, volatile memory, and non-volatile memory in a single IC. It should also be well understood that any functionality described herein can be performed, at least in part, by one or more hardware logic components, instead of software.

The controller 140 can communicate with an input device 160 that is operated by a user of the lighting device 100. The input device 160 can include a switch, a touch-sensitive surface, a microphone, a computing device, or any suitable device for communicating a user-initiated command to the controller 140. In one embodiment, the input device 160 is a switch and the user can provide commands to the controller 140 by operating the switch in various ways. Exemplary commands include switching the lighting device 100 on, switching the lighting device 100 off, and changing a mode of the lighting device 100. For example, the switch can be a push-button switch, and the user can place the lighting device 100 in a "sense-mode" by depressing the push-button switch for greater than a predetermined amount of time, such as 2.5 seconds, or about 1.5 to 3.5 seconds. In an alternate embodiment, the input device 160 can be a computing device. For example, the computing device can be "docked" or connected via a USB port or other suitable interface for communicating with controller 140, and commands can be entered via the computing device.

The user-interface of the lighting device 100 can be interactive by providing a visual, audible, or tactile output in response to user actions. For example, the lighting device 100 can include an output device, such as the light source 120, and the output device can be activated in various ways to communicate different messages to the user. For example, the light source 120 can briefly flash when the user depresses the push-button switch for greater than 2.5 seconds and the lighting device enters the "sense-mode." The output device can include the light source 120, an LED, a liquid crystal display, a speaker, a vibrator, or any device suitable for providing a user information.

The controller 140 can communicate with and activate the light source 120, such as via an electronically controlled switch 170. The electronically controlled switch 170 may supply more current to the light source 120 than an output of the controller 140, for example. In one embodiment, the electronically controlled switch 170 is a transistor, and an output of the controller 140 is connected to a base or gate of the transistor to control current flowing between a power supply 180 and the light source 120. When the electronically controlled switch 170 is switched off, the light source 120 is deactivated, and when the electronically controlled switch 170 is switched on, the light source 120 is activated. In an alternative embodiment, the controller 140 can activate and deactivate the light source 120 directly.

The power supply 180 provides electrical energy to the electrical and electronic components of the lighting device 100. The power supply 180 can include a battery, a fuel cell, or other portable source of power. For example, the power supply can include one or more batteries connected in series and/or parallel. In one embodiment, the power supply includes three AAA batteries connected in series.

Figure 2:
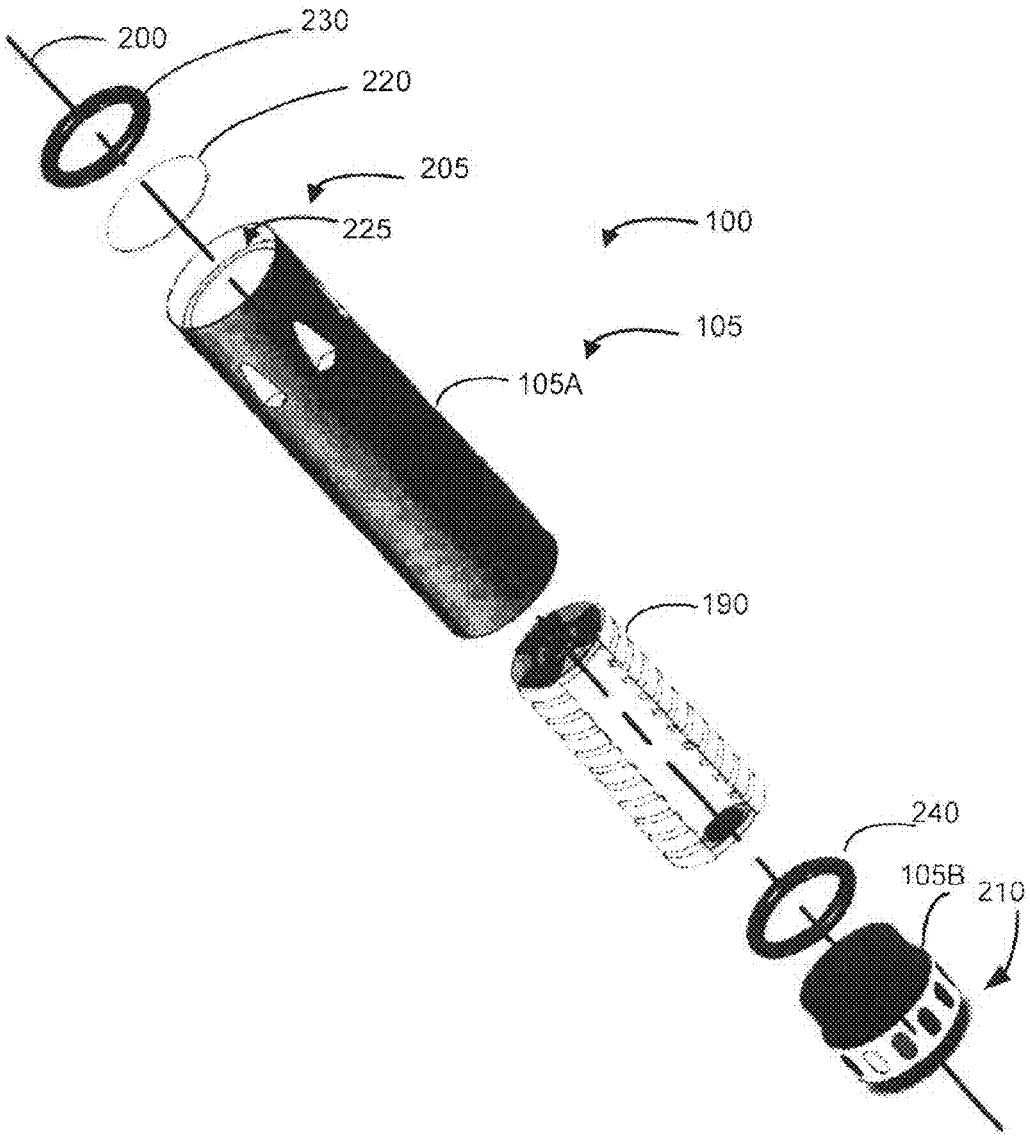
FIG. 2 is an isometric view of the lighting device of FIG. 1 in a disassembled condition.

Turning to the next figure, FIG. 2 is an isometric view of an embodiment of the lighting device 100 in a disassembled condition. Longitudinal axis 200 extends along a line between a target end 205 and an operator end 210 through a central axis of the lighting device 100. The outer surface of the lighting device 100 is generally defined by the housing 105. The housing 105 can include one or multiple sections that can be fastened together, such as with threads, to form a protective enclosure for components of the lighting device 100. In the illustrated embodiment, the housing can include a main section 105A and an electronics section 105B. It can be desirable for the sections to be unfastened by a user so that components of the lighting device 100, such as batteries of the power supply 180, can be replaced by the user. The housing 105 can be generally cylindrical with an opening at the target end 205 for allowing light generated by the light source 120 to be directed out of the target end 205. In one embodiment, the housing 105 has a diameter of one inch so that the lighting device 100 can be mounted to a weapon using one inch scope rings. The housing 105 can be constructed of plastic, metal, or other rigid material that is not likely to degrade after repeated firing of the weapon. In one embodiment, the housing 105 can include one or more markings for calibrating the lighting device 100. For example, the housing 105 can include a line that corresponds to an orientation for mounting the lighting device 100, and the line can be aligned with a reference direction, such as a vertical direction, when mounting the lighting device 100 on the weapon.

The target end 205 of housing 105 can be covered with a covering 220. The covering 220 can be glass, plastic, or any material that is generally transparent for one or more frequencies of light generated by the light source 120. The covering 220 can include one or more lenses over all or a portion of the covering 220. For example, the covering 220 can include a bulls-eye lens having a central magnifying lens surrounded by an annular straight-sided portion, such as described with reference to FIGS. 6A-6B. In one embodiment, the covering 220 can rest on a lip 225 of the housing 105 and be held in place by a ring 230. The ring 230 can be a flexible or a rigid material and can be secured to the housing 105 by an adhesive, a weld, threads, or friction, for example. In one embodiment, the target end 205 of housing 105 can include windage and elevation screws for aiming a lens portion of covering 220. For example, the target end 205 of the housing 105 can include one or more worm drives for adjusting the pitch and yaw of the covering 220. An operator can adjust the worm drive to co-witness the beam of light from lighting device 100 with a sight of the weapon. In an alternative embodiment, the beam of light from lighting device 100 can be co-witnessed via adjustable mounting brackets for mounting the lighting device 100 to the weapon. The housing 105 can be generally hollow for receiving the heat-sink 190 and the power supply 180 (not shown in FIG. 2). In one embodiment, and as described further with reference to FIGS. 4A-4B, the heat-sink 190 can be formed to receive one or more batteries (not shown) of the power supply 180. Referring again to FIG. 2, the power supply 180 can be electrically connected to the light source in the main section 105A and to the electronics in the electronics section 105B when the main section 105A and the electronics section 105B are fastened together. A gasket or O-ring 240 can be used to form a seal of the housing 105 when the electronics section 105B and the main section 105A are fastened together. For example, the gasket or O-ring 240 can be seated in a groove of the electronics section 105B and be compressed when the electronics section 105B and the main section 105A are fastened together.

Figure 3:
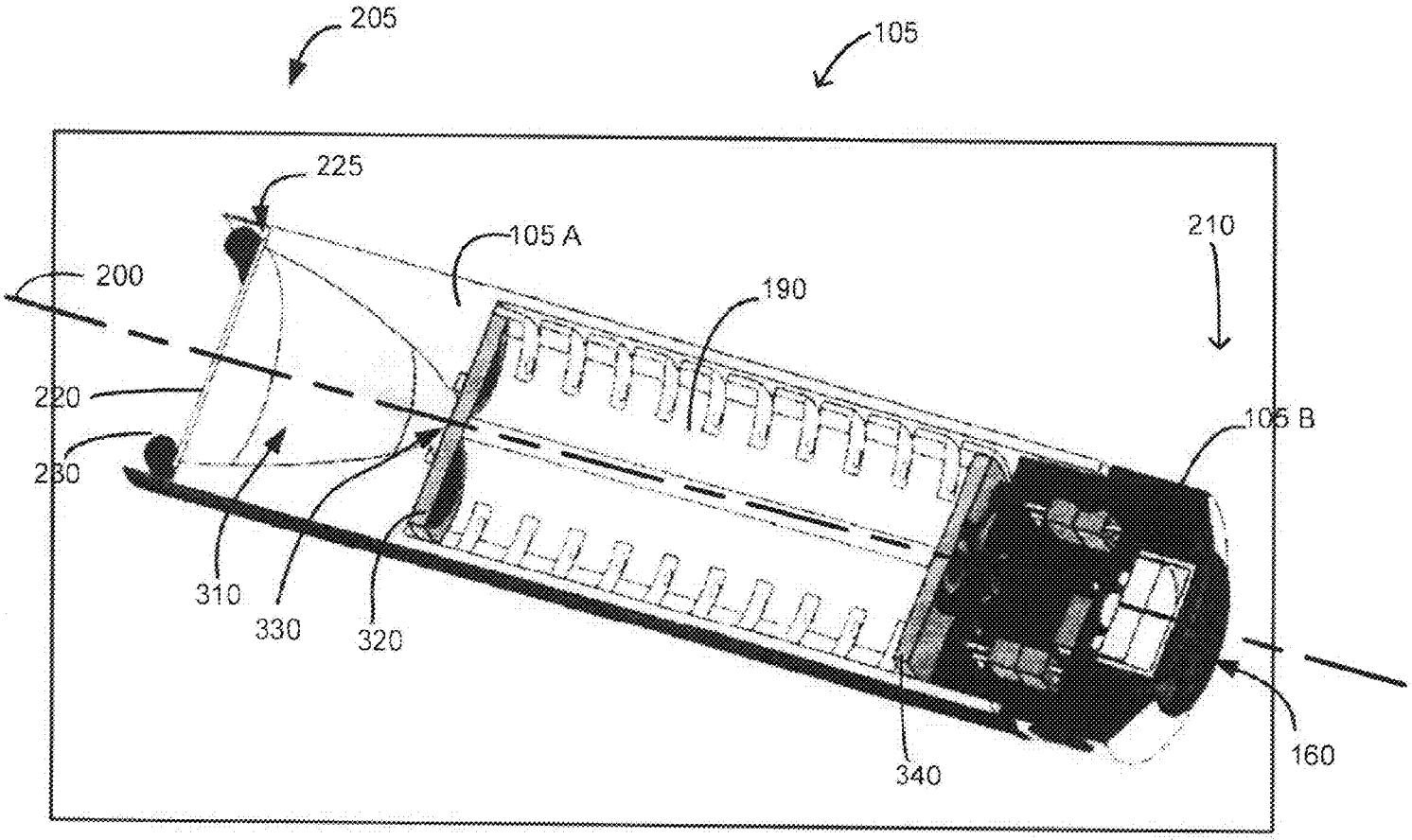
FIG. 3 is a longitudinal cross-sectional view of the lighting device of FIG. 1.

FIG. 3 is a longitudinal cross-sectional view of the lighting device 100 in an assembled condition. The housing 105 can include a parabolic cavity 310 near the target end 205. The light source 120 (a LED for example) can be mounted on a circuit board 320 which fits between the parabolic cavity 310 and the heat-sink 190 when the lighting device 100 is assembled. Circuit board 320 can form an electrical connection between the power supply 180 and the electrical and electronic components in the main section 105A. As described further with reference to FIGS. 5A and 5B, the light source 120 can be positioned near position 330 to reflect and direct the light in a beam generally along the longitudinal axis 200 and out of the target end 205.

A circuit board 340 is positioned near the operator end 210, fitting between the heat-sink 190 and the electronics section 105B when the lighting device 100 is assembled. Circuit board 340 can form an electrical connection between the power supply 180 and the electrical and electronic components in the electronics section 105B. In the illustrated embodiment, the input device 160 is a push-button switch located at the target end 205 of the lighting device 100. The heat-sink 190 is close to and in thermal contact with light source 120 and housing 105. It may be desirable for the heat-sink 190 and the housing 105 to be constructed of a material with high thermal conductivity, such as metal or composite materials that include silicon or carbon. Thus, heat-sink 190 and housing 105 can cooperate to transfer thermal energy from the light source 120 to the air surrounding the housing 105. In one embodiment, housing 105 includes an integral parabolic cavity 310 and the material forming the parabolic cavity 310 is in thermal contact with the heat-sink 190 to cooperatively transfer thermal energy from the light source 120 to the air surrounding the housing 105. In one embodiment, housing 105 may include through-holes in proximity to the heat-sink 190 for increasing air-flow around the heat-sink 190.

Figure 4B:
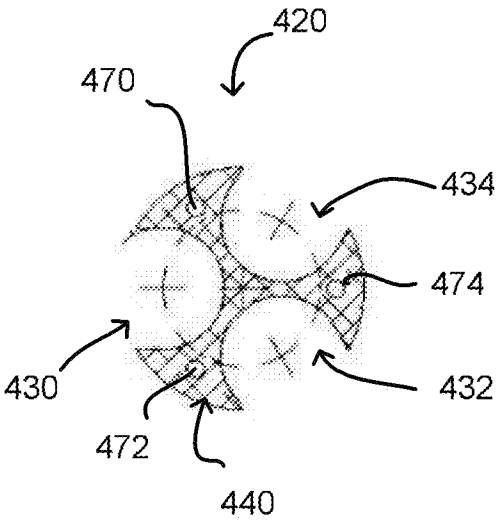
FIG. 4B is a cross-sectional view of the heat-sink taken along line 4B-4B of FIG. 4A.
Figure 4A:
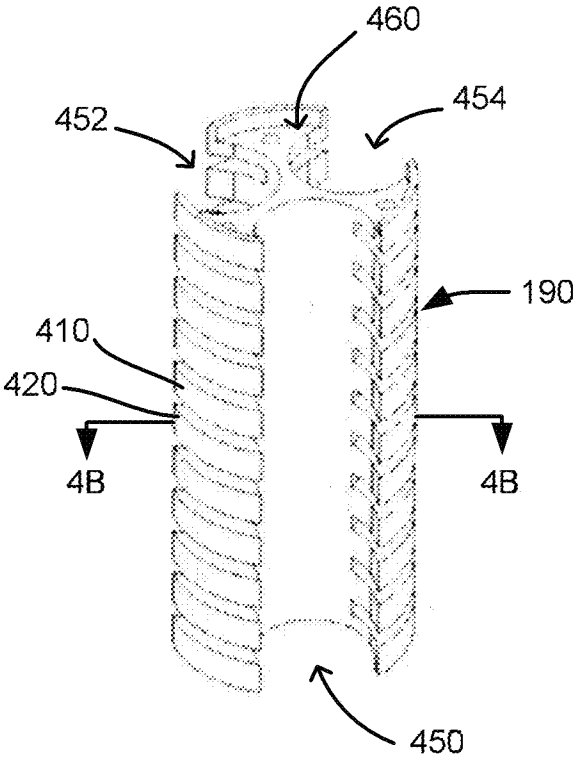
FIG. 4A is an isometric view of an embodiment of a heat-sink of the lighting device of FIG. 1.

FIGS. 4A and 4B show the heat-sink 190 in more detail. FIG. 4A is an isometric view of the heat-sink 190 and FIG. 4B is a cross-sectional view of the heat-sink of FIG. 4A, the cross-section taken through a fin 420, along the line 4B-4B. The heat-sink 190 may include multiple fins, such as fins 410 and 420. The fins can project radially from the longitudinal axis of the heat-sink 190. The number of fins can vary, with more fins adding more surface area to the heat-sink 190. The illustrated embodiment includes eleven fins. A range of eight to fifteen fins may be desirable. Respective fins can include one or more cut-outs near a perimeter of the respective fin, such as cut-outs 430, 432, and 434 near the perimeter 440 of fin 420. The cut-outs of adjacent fins can form one or more cavities of the heat-sink 190, such as cavities 450, 452, and 454. The respective cavities can be shaped to receive a battery of the power supply 180. For example, a AAA battery has a diameter of about 0.41 inches and a height of about 1.75 inches. Thus, the respective cut-outs can be semi-circular with a diameter slightly larger than 0.41 inches (such as 0.438 inches, for example) to receive a AAA battery. The heat-sink 190 can be at least as long as the length of a battery and any supporting physical structure and electrical connections. For example, the heat-sink 190 can be two inches long to accommodate the 1.75 inch long battery and support structure. In the illustrated embodiment, all fins include a semicircular cut-out to form the cavity for receiving the battery. In an alternate embodiment, the heat-sink 190 can be longer than a battery and its support structure such that a majority of the fins (e.g., adjacent fins) include cut-outs to receive the battery, but other fins do not have a cut-out.

Each end of the heat-sink 190 can include a recess, such as recess 460, in the outer-most fins for holding support structure, such as circuit boards 320 and 340. The circuit boards 320 and 340 can include one or more springs or tabs for making electrical contact to a battery and one or more wires or traces for connecting the batteries to each other and to the other components of the lighting device 100. For example, circuit boards 320 and 340 can include traces for wiring the batteries of the power supply 180 in series. The heat-sink 190 can include one or more through-holes, such as holes 470, 472, and 474, running parallel to the longitudinal axis of the heat-sink 190. The holes 470-474 can be used for routing wires between the circuit boards 320 and 340, for example.

Figure 5B:
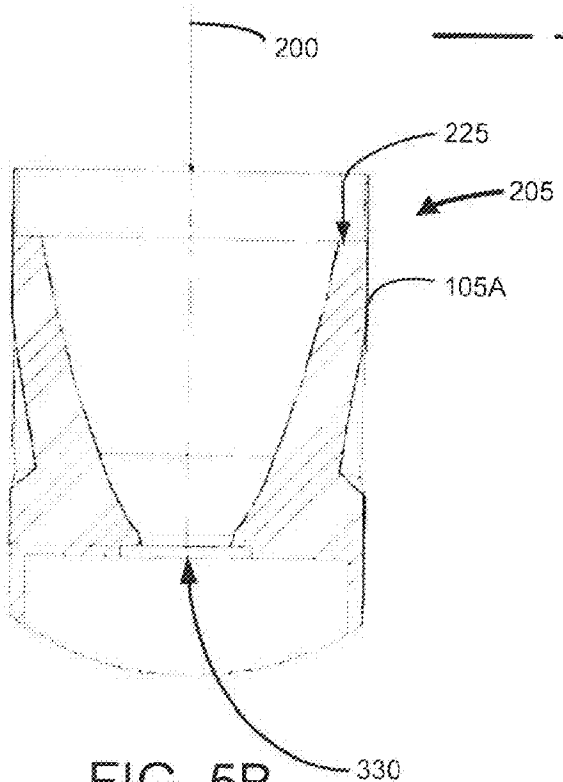
FIGS. 5A-5B illustrate a cross-sectional view of an embodiment of a light housing of the lighting device of FIG. 1.
Figure 5A:
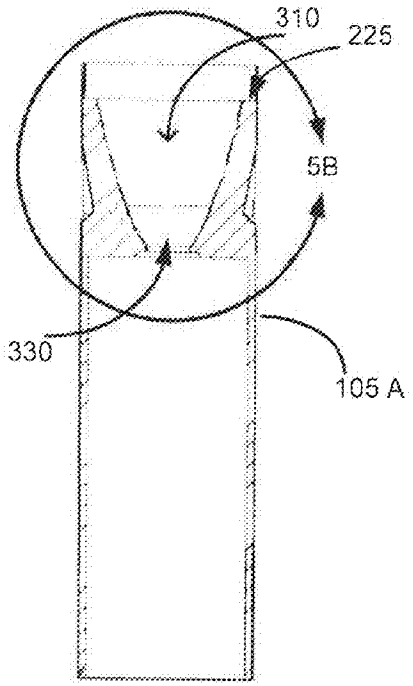

FIGS. 5A-5B and 6A-6B illustrate embodiments of components of the optics 130. The optics 130 can be used to direct light from the light source 120 toward a target area. FIGS. 5A-5B illustrate a cross-sectional view of the main section 105A of housing 105. The main section 105A can include a parabolic cavity 310 near the target end 205. The parabolic cavity 310 can be used to fully or partially collimate light from an un-collimated light source, such as a point light source (e.g., a LED or incandescent lamp). In other words, the parabolic cavity 310 can be used to direct the light from light source 120 in a beam generally along the longitudinal axis 200 and out of the target end 205. For example, light from the light source 120 can be emitted with a spherical wavefront and the parabolic cavity 310 can act as a parabolic mirror to reflect and direct the light in a fully or partially collimated beam generally along the longitudinal axis 200 and out of the target end 205. In one embodiment, the parabolic cavity 310 can include a coating of a highly reflective material. The parabolic cavity 310 can be polished to increase the reflectance of the parabolic cavity 310. The light source 120 can be positioned at a position 330 near a focus of the parabolic cavity 310 along a longitudinal axis of the parabolic cavity. In the illustrated embodiment, the longitudinal axis of the parabolic cavity is coincident with the longitudinal axis 200. In an alternative embodiment, the longitudinal axis of the parabolic cavity can be offset from the longitudinal axis 200.

Figure 6A:
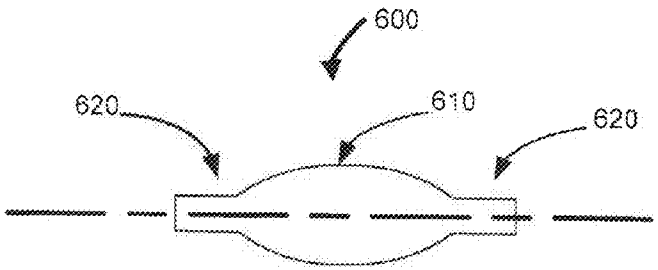
FIGS. 6A-6B illustrate side and front views of an embodiment of a lens of the lighting device of FIG. 1.
Figure 6B:
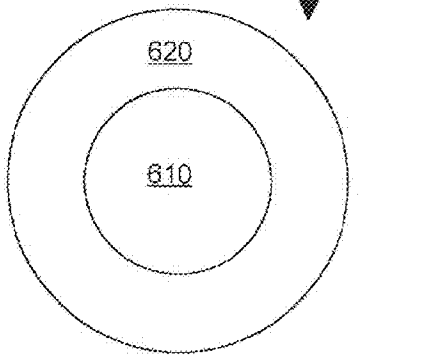

The collimated light can be directed through a cover or a lens that is placed perpendicular to the longitudinal axis 200. FIG. 6A illustrates a side view of an embodiment of a lens 600 of lighting device 100. FIG. 6B illustrates a front view of the lens 600. The lens 600 can be configured to present a brighter central beam surrounded by a less bright halo concentrically arranged around the center of the central beam when the light source 120 is activated. For example, the lens 600 can include a magnified ring in a central portion of the lens. In one embodiment, the lens 600 includes a double convex central lens portion 610 surrounded by an annular straight sided lens portion 620. The lens 600 can be positioned near an end of the parabolic cavity 310 farthest from the vertex of the parabolic cavity 310, e.g., near the target end 205. For example, the lens 600 can be secured so that the periphery of the lens 600 abuts the lip 225 of the main section 105A of the housing 105. By using one or more halos or concentric circles of light of different intensities, the halos can help an operator make a rough or approximate aim using the halos as a guide for aiming.

In an alternative embodiment, the light source 120 and the optics 130 can be configured to illuminate the portion of the target with a pin-point spot when the light source 120 is activated. For example, the light source 120 can be a laser and optics 130 can include a transparent cover that is generally flat. The laser can emit a narrow beam of collimated light at a wavelength within the wavelength range of human visual perception, e.g., between 400 and 700 nanometers, to illuminate the portion of the target with the pin-point spot when the laser is activated.

Figure 7C:
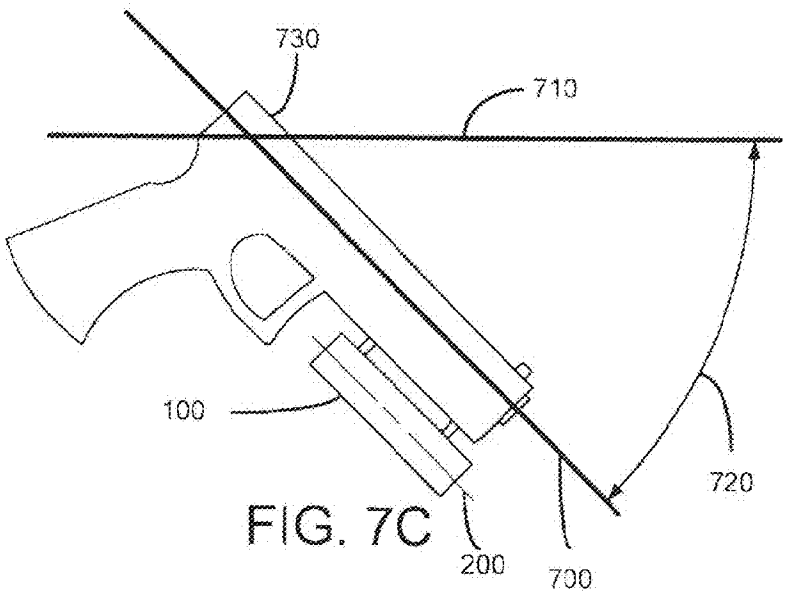
FIGS. 7A-7C are schematic views of a firearm having the lighting device of FIG. 1 mounted thereto, and illustrate different pitches associated with the firearm.
Figure 7A:
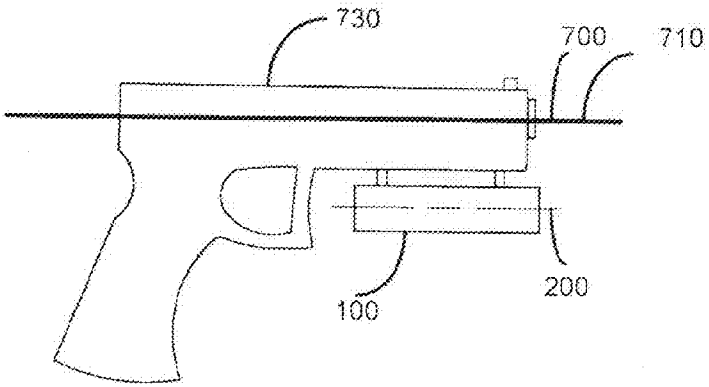
Figure 7B:
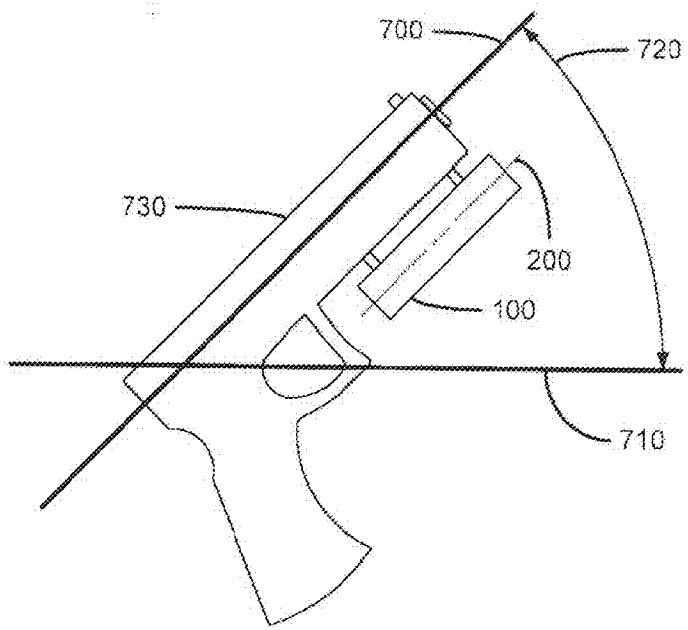
Figure 8C:
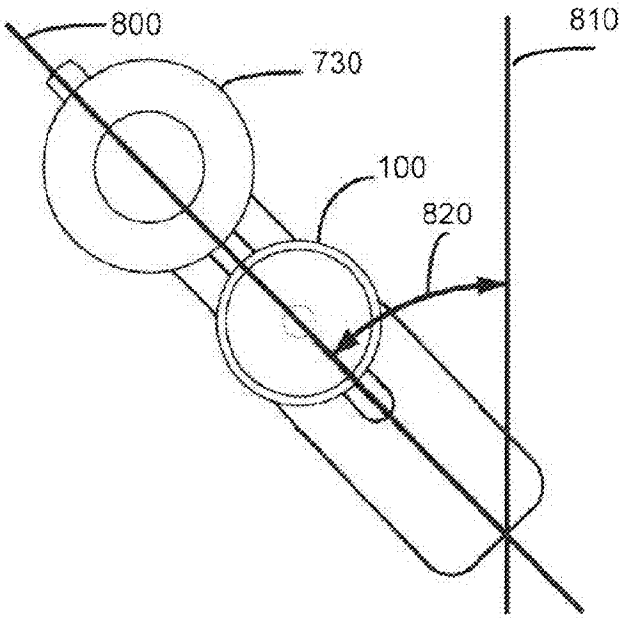
FIGS. 8A-8C are schematic views of a firearm having the lighting device of FIG. 1 mounted thereto, and illustrate different rolls associated with an embodiment of a weapon system.
Figure 8B:
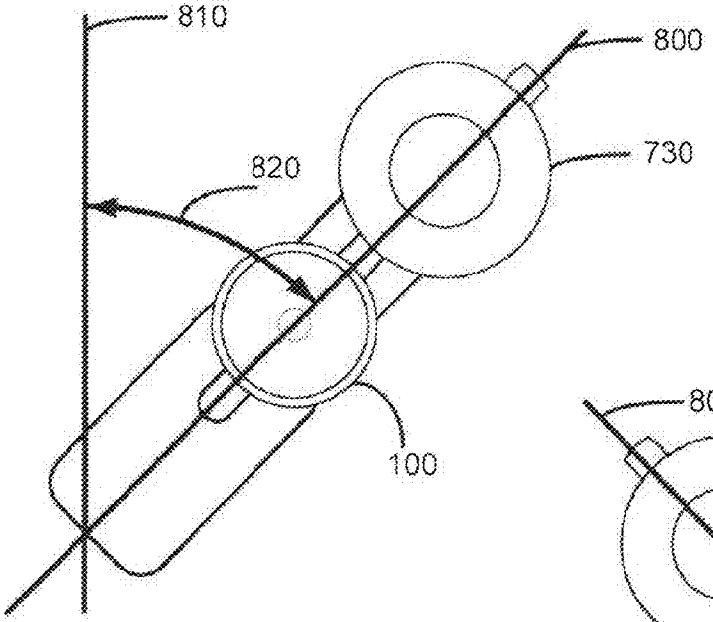
Figure 8A:
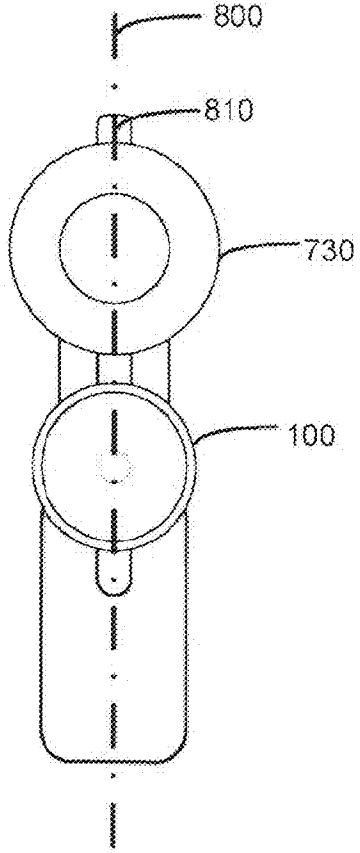

FIGS. 7A-7C and 8A-8C are schematic views of a firearm 730 having the lighting device 100 mounted thereto. For example, the lighting device 100 can be mounted to the firearm 730 using one inch scope rings. FIGS. 7A-7C illustrate side views of the firearm 730 and the lighting device 100 and FIGS. 8A-8C illustrate front views of the firearm 730 and the lighting device 100. The firearm 730 can include a firing line 700 which corresponds to an initial direction a projectile will follow when fired from the firearm 730. During mounting of the lighting device 100, the longitudinal axis 200 of the lighting device 100 can be aligned to be generally parallel to the firing line 700. Thus, light from the lighting device 100 can be directed toward a target of the firearm 730 and the light can be used to fully or partially illuminate a portion of the target area. In other words, a sight of the weapon and the lighting device 100 can be co-witnessed.

FIGS. 7A-7C illustrate different pitches associated with the firearm 730. It can be desirable to align the longitudinal axis 200 of the lighting device 100 generally parallel to the firing line 700 so that the pitch associated with the firearm 730 will generally correspond to the pitch associated with the lighting device 100. The pitch 720 can be measured relative to a reference plane or a reference axis 710. For example, the pitch 720 can be the angular difference between the firing line 700 and the reference axis 710. As described below with reference to FIGS. 9 and 10, the reference axis 710 can be determined during a calibration mode of the lighting device 100. For example, during the calibration mode, the reference axis 710 can be determined to be a horizontal plane or axis. As shown in FIG. 7A, the reference axis 710 and the firing line 700 can be coincident, e.g., the pitch 720 is zero degrees, such as when the firearm 730 is being aimed, in a firing position, along the reference axis 710. Thus, the reference axis 710 can correspond to the firing line 700 when the firearm 730 is held level, in the firing position.

Activating and deactivating the light from lighting device 100 can be based, in part, on the pitch 720 of the firearm 730. For example, the pitch 720 of the firearm 730 can be used to determine if the firearm 730 is in a firing position or a non-firing position. FIG. 7B shows the firearm 730 pointed in an upward direction, with a positive pitch 720. When the pitch 720 exceeds a first predetermined angle, the firearm 730 can be in a non-firing position. The first predetermined angle can be selected based on a number of factors such as a pitch of an operator's high-ready position and potential terrain encountered by the operator. The high-ready position is a non-firing position where the operator is holding the firearm 730 generally upward. The first predetermined angle can be less than the pitch 720 of the firearm 730 in the high-ready position. To reduce the likelihood of the light inadvertently switching on, the first predetermined angle can be reduced so that the angle is less than the pitch 720 of the firearm 730 in the high-ready position. On the other hand, the operator may encounter a suspect going up a flight of stairs or in an elevated position, and the operator may aim the firearm 730 at a pitch 720 with a positive angle above the reference axis 710.

FIG. 7C shows the firearm 730 pointed in a downward direction, with a negative pitch 720. When the pitch 720 is less than (e.g., more negative than) a second predetermined (negative) angle, the firearm 730 can be in a non-firing position. For example, the second predetermined angle can be negative sixty degrees, and the firearm 730 can be in a non-firing position when the pitch 720 is negative sixty-five degrees. The second predetermined angle can be selected based on a number of factors such as a pitch of an operator's low-ready position and potential terrain encountered by the operator. The low-ready position is a non-firing position where the operator is holding the firearm 730 generally downward. The second predetermined angle can be greater than the pitch 720 of the firearm 730 in the low-ready position. To reduce the likelihood of the light inadvertently switching on, the second predetermined angle can be increased so that the angle is greater than the pitch 720 of the firearm 730 in the low-ready position. On the other hand, the operator may encounter a suspect going down a flight of stairs or in a depression, and the operator may aim the firearm 730 at a pitch 720 with a negative angle below the reference axis 710. Thus, there can be a trade-off between the range of pitch angles associated with the firing position and a margin for reducing the likelihood of inadvertently switching the light on.

The absolute value of the first predetermined angle and the second predetermined angle can be the same or different. In one embodiment, the firing position can include a pitch 720 of the firearm 730 within plus or minus sixty degrees of the reference axis 710. In an alternate embodiment, the firing position can include a pitch 720 of the firearm 730 within plus or minus forty-five degrees of the reference axis 710. The firing position can include a pitch set at other angles as well.

FIGS. 8A-8C illustrate different rolls associated with the firearm 730 having the lighting device 100 mounted thereto. The firearm 730 can include a vertical axis 800 which corresponds to an axis of the firearm 730 that is aligned with the vertical direction when the firearm 730 is in a firing position. The roll 820 can be measured relative to a reference plane or a reference axis 810. For example, the roll 820 can be the angular difference between the vertical axis 800 and the reference axis 810. As described below with reference to FIGS. 9 and 10, the reference axis 810 can be determined during a calibration mode of the lighting device 100. For example, during the calibration mode, the reference axis 810 can be determined to be a vertical plane or axis. As shown in FIG. 8A, the reference axis 810 and the vertical axis 800 can be coincident, e.g., the roll 820 is zero degrees, such as when the firearm 730 is being held upright and aimed, in a firing position. Thus, the reference axis 810 can correspond to the vertical axis 800 when the firearm 730 is held upright, in the firing position.

Activating and deactivating the light from lighting device 100 can be based, in part, on the roll 820 of the firearm 730. For example, the roll 820 of the firearm 730 can be used to determine if the firearm 730 is in a firing position or a non-firing position. FIG. 8B shows the firearm 730 rolled in a counter-clockwise direction (from the operator's perspective), with a positive roll 820, and FIG. 8C shows the firearm 730 rolled in a clockwise direction (from the operator's perspective), with a negative roll 820. When the absolute value of the roll 820 exceeds a predetermined angle, the firearm 730 can be in a non-firing position. For example, the firearm 730 can be in a non-firing position when the firearm 730 is laid down on its side, e.g., the absolute value of the roll 820 is about ninety degrees. During repeated rapid firing, the firearm 730 may have a non-zero roll 820 as the operator recovers from the recoil of the firearm 730. Also, some operators may hold and aim the firearm 730 with a non-zero roll 820. Thus, as with the pitch, there is a trade-off between the range of roll angles associated with the firing position and a margin for reducing the likelihood of inadvertently switching the light on.

The absolute value of the predetermined angle for clockwise rotations and counter-clockwise rotations can be the same or different. In one embodiment, the firing position can include a roll 820 of the firearm 730 within plus or minus sixty degrees of the reference axis 810. In an alternate embodiment, the firing position can include a roll 820 of the firearm 730 within plus or minus forty-five degrees of the reference axis 810, within plus or minus forty-five to sixty degrees, or some other angle.

Figure 9:
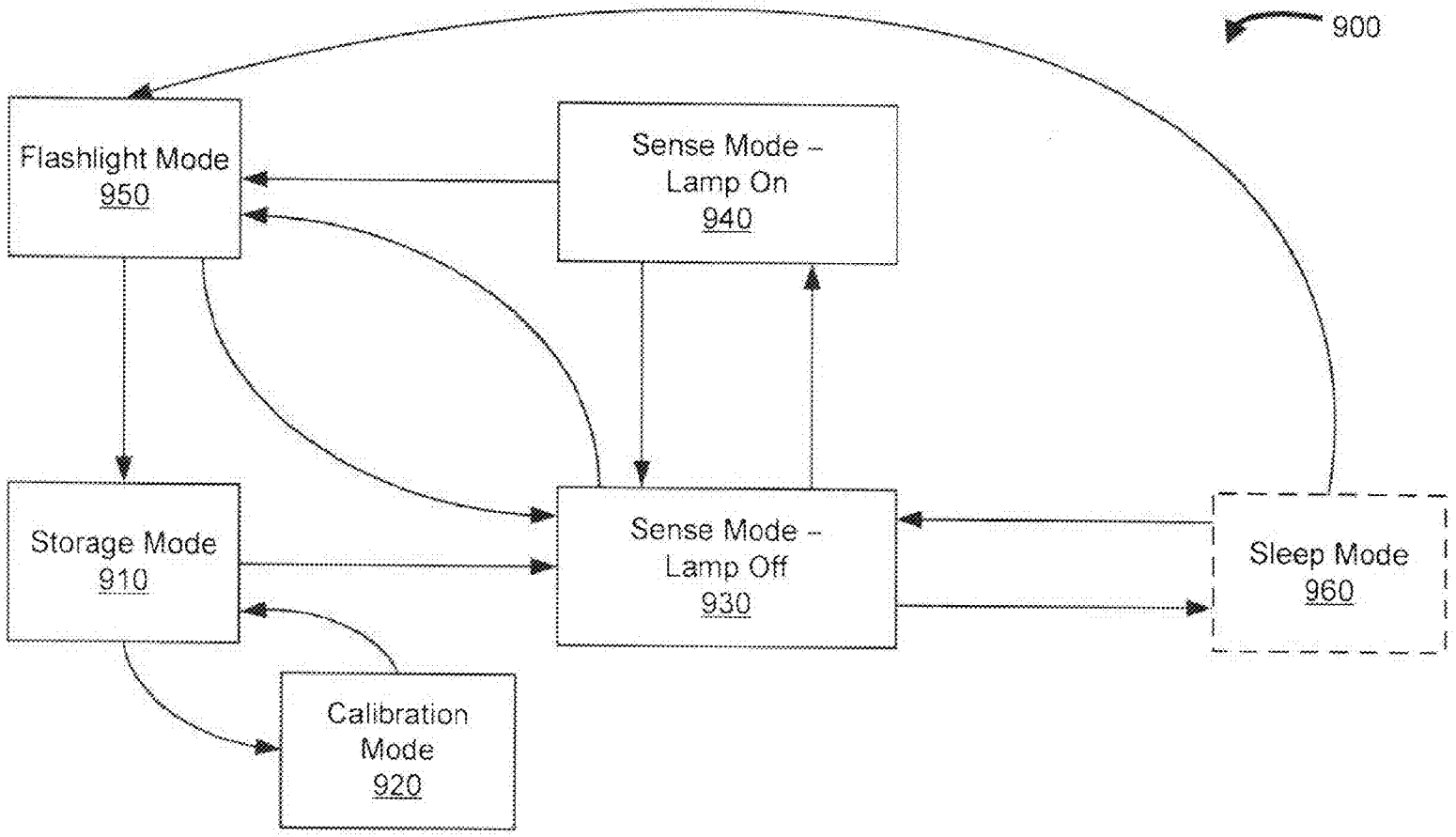
FIGS. 9-10 are flowcharts illustrating methods for controlling a light source mounted on a firearm.
Figure 10:
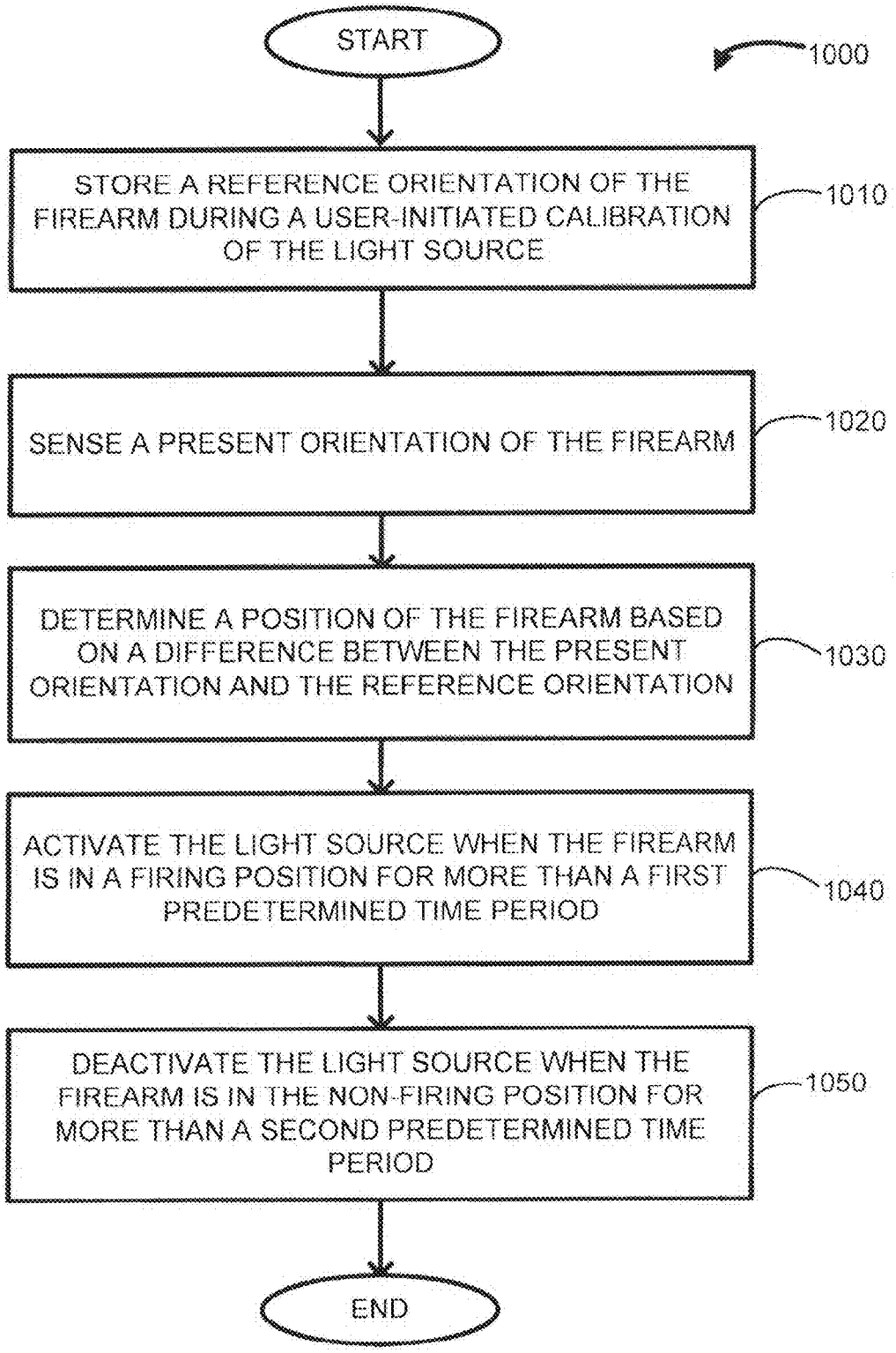

FIGS. 9-10 are flowcharts illustrating methods for controlling a light source mounted on a firearm. FIG. 9 is a flowchart illustrating an embodiment of a method 900 wherein a user of the lighting device 100 can change the operation of the lighting device 100 by transitioning the lighting device 100 to different modes. For example, the user can input a command via a user interface to change the mode of the lighting device 100. In the embodiment of FIG. 9, the user interface includes a push-button switch for entering commands (e.g., a mode switch) and the user interface provides feedback to the user via the light source 120. In other embodiments, the user interface can include a different input device for entering commands and/or a different output device for providing feedback to the user. Non-limiting examples of modes include a storage mode 910, a calibration mode 920, a sense mode with the lamp off 930, a sense mode with the lamp on 940, a flashlight mode 950, and a sleep mode 960.

The storage mode 910 can be the default state of the lighting device 100 and the lowest power state of the lighting device 100. For example, the user can place the lighting device 100 in the storage mode 910 to reduce battery drain when the user is not planning to use the lighting device 100. When the lighting device 100 is in the storage mode 910, the controller 140 can be placed in a low-power sleep mode until the user provides a command to the user interface via the mode switch. For example, the user can change the mode to the calibration mode 920 or to one of the sense modes 930 or 940. In one embodiment, the lighting device 100 can be transitioned from the storage mode 910 to the sense mode with the lamp off 930 by depressing the mode switch of the lighting device 100 for 2.5 seconds, and the lighting device 100 can be transitioned from the storage mode 910 to the calibration mode 920 by depressing the mode switch of the lighting device 100 for ten seconds. It may be desirable for the user to take a more deliberate action to transition to the calibration mode 920 as compared to transitioning to other modes, since inadvertently transitioning to the calibration mode 920 could change the reference orientation of the lighting device 100. Thus, it may be desirable for the user to depress the mode switch for a longer time period to enter the calibration mode 920 as compared to other modes.

The calibration mode 920 can be used to align the lighting device 100 to the firing position of a firearm that the lighting device 100 is mounted to. For example, the user can mount the lighting device 100 to the firearm and then switch the lighting device 100 to the calibration mode 920. The user can hold the firearm (and the lighting device 100 attached thereto) in the firing position during the calibration mode 920 and a reference orientation of the firearm can be determined and stored. The calibration mode 920 can be a transitional state, lasting for only for a predetermined time period, such as ten seconds. For example, the user can initiate a mode change to the calibration mode 920, the lighting device 100 can be in the calibration mode 920 for ten seconds, and then the lighting device 100 can switch back to the storage mode 910 after the ten seconds. While in the calibration mode 920, the lighting device 100 can signal it is in calibration mode 920 by activating the light source 120 in various ways. For example, the light source 120 can be steadily on, slowly flashing (such as one second on and one second off), or operating in a suitable manner to show the lighting device 100 is in the calibration mode 920.

The reference orientation can be based on one or more samples from an output of the inertial sensor 110 taken while the lighting device 100 is in the calibration mode 920. For example, the reference orientation can be based on an average of samples from the inertial sensor 110 to account for unsteadiness of a user's aim. Samples taken at the beginning of the calibration mode 920 may be less accurate than samples taken later in the calibration mode as the user transitions from operating the mode switch to aiming the firearm. Thus, samples at or near the end of the calibration period may be more desirable for determining the reference orientation. The samples from the inertial sensor 110 and the reference orientation can be stored in the memory 150 and/or the storage 155.

In the sense modes 930 and 940, the light source 120 is controlled based on the orientation of the firearm and the motion of the user. For example, the light source 120 can be activated when the firearm is in a firing position for more than a first predetermined time period, and the light source 120 can be deactivated when the firearm is in a non-firing position for more than a second predetermined time period. During the sense modes 930 and 940, samples can be periodically taken from the inertial sensor 110 to determine forces acting on the firearm, such as the pull of gravity. An orientation of the firearm can be determined based on the forces acting on the firearm. The orientation of the firearm can be compared to the reference orientation to determine a position of the firearm. Generally once in the sense modes 930 and 940, the lighting device 100 is in the sense mode with the lamp off 930 when the firearm is in a non-firing position, and the lighting device 100 is in the sense mode with the lamp on 940 when the firearm is in a firing position.

Generally, the light source 120 is deactivated when the lighting device 100 is in the sense mode with the lamp off 930. However, when the user operates the mode switch to transition the lighting device 100 into the sense mode with the lamp off 930, the light source 120 can be flashed to indicate the transition to the sense mode with the lamp off 930. In one embodiment, the light source 120 can be flashed twice when the user transitions the lighting device 100 to the sense mode with the lamp off 930. For example, the light source 120 can be activated for about 0.1 second, deactivated for about 0.1 second, activated for about 0.1 second, and then deactivated. During the sense mode with the lamp off 930, periodic samples can be taken from the inertial sensor 110 to determine if the orientation of the firearm is in the firing position (by comparing to the reference orientation). In one embodiment, the samples can be taken every 1.25 milliseconds (ms). The lighting device 100 can be switched to the sense mode with the lamp on 940 when the firearm is in the firing position for more than the first predetermined time period. For example, a timer can be started when a sample from the inertial sensor 110 indicates that the firearm is in the firing position. The timer can be reset when a sample from the inertial sensor 110 indicates that the firearm is in the non-firing position. If the timer exceeds the first predetermined time period, the lighting device 100 can be switched to the sense mode with the lamp on 940. As another example, the number of consecutive samples indicating that the firearm is in the firing position can be counted. The number of consecutive samples corresponds to a time period equal to the number of samples multiplied by the sampling period. If the number of consecutive samples are greater than the number of consecutive samples corresponding to the first predetermined time period, the lighting device 100 can be switched to the sense mode with the lamp on 940. In one embodiment, three consecutive samples, taken 1.25 ms apart, with the firearm in firing position can cause the lighting device 100 to switch to the sense mode with the lamp on 940.

The light source 120 is activated when the lighting device 100 is in the sense mode with the lamp on 940. During the sense mode with the lamp on 940, periodic samples can be taken from the inertial sensor 110 to determine if the orientation of the firearm is in the non-firing position (by comparing to the reference orientation). The samples can be taken at the same or a different frequency than when in the sense mode with the lamp off 930. In one embodiment, the samples can be taken every 250 ms. The lighting device 100 can be switched to the sense mode with the lamp off 930 when the firearm is in the non-firing position for more than the second predetermined time period. For example, a timer can be started when a sample from the inertial sensor 110 indicates that the firearm is in the non-firing position. The timer can be reset when a sample from the inertial sensor 110 indicates that the firearm is in the firing position. If the timer exceeds the second predetermined time period, the lighting device 100 can be switched to the sense mode with the lamp off 930. As another example, the number of consecutive samples indicating that the firearm is in the non-firing position can be counted. If the number of consecutive samples are greater than the number of consecutive samples corresponding to the second predetermined time period, the lighting device 100 can be switched to the sense mode with the lamp off 930. In one embodiment, ten consecutive samples, taken 250 ms apart, with the firearm in non-firing position can cause the lighting device 100 to switch to the sense mode with the lamp off 930.

The lighting device 100 can include a flashlight mode 950 that can be used to activate the light source 120 independently of the orientation of the lighting device 100 or the motion of the user. Generally, the light source 120 is activated when the lighting device 100 is in the flashlight mode 950. However, when the user operates the mode switch to transition the lighting device 100 to the flashlight mode 950, the light source 120 can be flashed three times to indicate the transition, for example. In one embodiment, the user can initiate the flashlight mode by momentarily (for less than 2.5 seconds, for example) depressing the mode switch when the lighting device 100 is in the sense mode with the lamp off 930, the sense mode with the lamp on 940, or the sleep mode 960. The brightness of the light source 120 can be the same or different in the flashlight mode 950 and the sense mode with the lamp on 940. For example, the electronically controlled switch 170 can be adjusted to provide more or less current to the light source 120 based on the mode of the lighting device 100. The lighting device 100 can be transitioned from the flashlight mode 950 to the sense mode with the lamp off 930 when the user momentarily depresses the mode switch, for example. The lighting device 100 can be transitioned from the flashlight mode 950 to the storage mode 910 when the user depresses the mode switch for greater than 2.5 seconds, for example.

The lighting device 100 can include a sleep mode 960 that can be used to conserve battery life when the orientation of the firearm has not changed for a third predetermined time period. In one embodiment, the third predetermined time period can be thirty minutes. During the sleep mode 960, the controller 140 and other components of the lighting device 100 can be put in a low-power mode. As one example, the frequency of sampling the inertial sensor 110 (and the calculations associated with each sample) can be reduced as compared to sampling frequency in the sense mode. In one embodiment, the sampling frequency of the inertial sensor 110 can be reduced to once every ten seconds. If the orientation of the lighting device 100 has not changed by more than a margin of error in consecutive samples, the lighting device 100 can remain in the sleep mode 960. The margin of error can be used to account for sensor drift so that minor variations in orientation do not inadvertently take the lighting device 100 out of the sleep mode 960. If the orientation of the lighting device 100 changes by more than the margin of error in consecutive samples, the lighting device 100 can exit the sleep mode 960 and transition to the sense mode with the lamp off 930.

Various other modes are possible. For example, a strobe mode can be entered after the firearm is fired. The strobe mode can flash the light source 120 at a periodic or non-periodic rate. The strobe mode may be desirable to disorient a suspect after the firearm is fired. For example, the controller 140 can detect that the firearm has been fired based on the forces sampled from the inertial sensor 110. For example, a recoil after firing the firearm may be characterized by a sharp acceleration counter to the target end 205 of the lighting device 100. The strobe mode can be exited after a predetermined time period or based on the user operating the input device 160, for example.

FIG. 10 is a flowchart illustrating an embodiment of a method 1000 for controlling the light source 100. At 1010, a reference orientation of the firearm can be stored during a user-initiated calibration of the light source 100. For example, the user can hold the firearm (and the light source 100 attached to the firearm) in a firing position and the user can transition the lighting device 100 to the calibration mode 920 by entering a command via the input device 160. During the calibration mode, the controller 140 can take one or more samples of an output of the inertial sensor 110, the samples being indicative of the orientation of the firearm in the firing position. The controller 140 can calculate the reference orientation based on the one or more samples. For example, the reference orientation can include two or more reference axes, such as reference axes 710 and 810, corresponding to a firing position of the firearm. The reference orientation can be stored in the memory 150 or the storage 155.

At 1020, a present orientation of the firearm can be sensed. For example, the output of the inertial sensor 110 can be sampled, the sample being indicative of the present orientation of the firearm. In one embodiment, the sample can be taken when the light source is in the sense modes 930 and 940.

At 1030, a position of the firearm can be determined. The position can be based on a difference between the present orientation and the reference orientation. For example, the position can be based on the pitch 720 and the roll 820 of the firearm, where the pitch 720 and the roll 820 are relative to the reference axes of the reference orientation. The position can include a firing position and a non-firing position. The firing position and the non-firing position can be mutually exclusive or partially overlapping. In one embodiment, the firing position and the non-firing position are mutually exclusive, and the firing position includes a roll 820 of the firearm within plus or minus sixty degrees of the reference axis 810 and a pitch 720 of the firearm within plus or minus sixty degrees of the reference axis 710. In an alternate embodiment, the firing position and the non-firing position are mutually exclusive, and the firing position includes a roll 820 of the firearm within plus or minus forty-five degrees of the reference axis 810 and a pitch 720 of the firearm within plus or minus forty-five degrees of the reference axis 710.

At 1040, the light source 120 can be activated when the firearm is in the firing position for more than a first predetermined time period. For example, the first predetermined time period can be between one millisecond and one second.

At 1050, the light source 120 can be deactivated when the firearm is in the non-firing position for more than a second predetermined time period. For example, the first predetermined time period can be between 0.5 second and five seconds.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. We therefore claim as our invention all that comes within the scope and spirit of these claims.

We claim:

1. A lighting device for mounting on a weapon, comprising:

a light source to illuminate a portion of a target;

an inertial sensor for sensing forces acting on the lighting device; and a controller in communication with the light source and the inertial sensor, the controller configured to:

activate the light source when the lighting device is in a firing position for more than a first predetermined time period; and deactivate the light source when the lighting device is in a non-firing position for more than a second predetermined time period.

2. The lighting device of claim 1, wherein the firing position and the non-firing position are mutually exclusive, and the firing position includes a roll of the lighting device within plus or minus sixty degrees of upright and a pitch of the lighting device within plus or minus sixty degrees of horizontal.

3. The lighting device of claim 1, wherein the controller is further configured to calibrate the lighting device when a user puts the lighting device in a calibration mode, the calibration including basing a reference orientation on one or more samples from an output of the inertial sensor during the calibration mode.

4. The lighting device of claim 3, further comprising a switch in communication with the controller, and wherein the controller is further configured to enter the calibration mode when the switch is operated in a predetermined manner.

5. The lighting device of claim 4, wherein the switch is a push-button switch and the calibration mode is entered when the push-button switch is pressed by the user for more than a third predetermined amount of time.

6. The lighting device of claim 1, wherein the first predetermined time period is between one millisecond and one second.

7. The lighting device of claim 1, wherein the second predetermined time period is between 0.5 second and five seconds.

8. The lighting device of claim 1, further comprising a heat-sink defining a cavity for receiving a battery in the cavity, the heat-sink in thermal contact with the light source.

9. The lighting device of claim 8, wherein the heat-sink is metallic and the heat-sink includes a plurality of fins projecting radially from a central axis of the heat-sink, a majority of the fins including a semicircular cut-out near a perimeter of a respective fin, the semicircular cut-outs of adjacent fins forming the cavity for receiving the battery.

10. The lighting device of claim 1, further comprising a housing including a polished parabolic cavity, the light source positioned near a focus of the parabolic cavity along a longitudinal axis of the parabolic cavity.

11. The lighting device of claim 1, further comprising optics configured to present a brighter central beam surrounded by a less bright halo concentrically arranged around the center of the central beam when the light source is activated.

12. The lighting device of claim 11, wherein the optics comprise a lens including a double convex central lens portion surrounded by an annular straight sided lens portion, the lens positioned near an end of the parabolic cavity farthest from the vertex of the parabolic cavity.

13. The lighting device of claim 1, wherein the light source is configured to illuminate the portion of the target with a pin-point spot when the light source is activated.

14. A system, comprising:

a weapon;

a light source connected to the weapon and oriented to illuminate an area within a range of the weapon when the light source is activated;

an inertial sensor for sensing forces acting on the weapon; and a controller configured to:

store a reference orientation of the weapon based on one or more samples of an output of the inertial sensor when the system is in a calibration mode selected by a user of the system;

determine a position of the weapon based on a difference between the reference orientation and a present orientation of the weapon;

activate the light source when the weapon is in a firing position for more than a first predetermined time period; and deactivate the light source when the weapon is in a non-firing position for more than a second predetermined time period.

15. The system of claim 14, wherein the firing position and the non-firing position are mutually exclusive, and the firing position includes a roll of the weapon within plus or minus sixty degrees of upright and a pitch of the weapon within plus or minus sixty degrees of horizontal, the pitch and roll measured relative to the reference orientation.

16. The system of claim 14, further comprising a push-button switch in communication with the controller, and wherein the controller is further configured to put the system in calibration mode when the push-button switch is pressed for more than a third predetermined amount of time.

17. The system of claim 14, further comprising optics configured to present a brighter central beam surrounded by a less bright halo concentrically arranged around the center of the central beam when the light source is activated.

18. A computer-readable storage including instructions thereon for executing a method for controlling a light source for mounting on a firearm, the method comprising:

storing a reference orientation of the firearm during a user-initiated calibration of the light source;

sensing a present orientation of the firearm;

determining a position of the firearm based on a difference between the present orientation and the reference orientation, the position consisting of a firing position and a non-firing position;

activating the light source when the firearm is in the firing position for more than a first predetermined time period; and deactivating the light source when the firearm is in the non-firing position for more than a second predetermined time period.

19. The computer-readable storage of claim 18, wherein the first predetermined time period is between one millisecond and one second and the second predetermined time period is between 0.5 second and five seconds.

20. The computer-readable storage of claim 18, wherein the firing position and the non-firing position are mutually exclusive, and the firing position includes a roll of the firearm within plus or minus sixty degrees of upright and a pitch of the firearm within plus or minus sixty degrees of horizontal, the pitch and roll measured relative to the reference orientation.

21. A lighting device for mounting to a hand-held weapon, comprising:

a light source to illuminate at least a portion of a target;

an inertial sensor for sensing forces acting on the lighting device and weapon; and a controller in communication with the light source and the inertial sensor, the controller having a system to:

sample outputs from the inertial sensor at preset time intervals to establish a physical orientation for the lighting device and the weapon, compare the physical orientation to a reference orientation, and responsively activate or deactivate the light source when the relationship between the physical and reference orientations fall within a preset value range for a predetermined time period.

* * * * *